US008479612B2

(12) United States Patent
Sergyeyenko et al.

(10) Patent No.: US 8,479,612 B2
(45) Date of Patent: Jul. 9, 2013

(54) HAMMER WITH NAIL START ACCESSORY, AND METHOD

(75) Inventors: Oleksiy P. Sergyeyenko, Ottawa (CA); David Keith Wheeler, Gananoque (CA)

(73) Assignee: Black & Decker Inc., Newark, DE (US)

( * ) Notice: Subject to any disclaimer, the term of this patent is extended or adjusted under 35 U.S.C. 154(b) by 152 days.

(21) Appl. No.: 12/339,978

(22) Filed: Dec. 19, 2008

(65) Prior Publication Data

US 2010/0154598 A1 Jun. 24, 2010

(51) Int. Cl.
*B25D 1/04* (2006.01)
*B25G 1/08* (2006.01)
*B25C 3/00* (2006.01)

(52) U.S. Cl.
USPC ..... 81/23; 7/143; 7/167; 81/44; 81/490

(58) Field of Classification Search
USPC ... 81/23, 44, 20, 490, 24; 254/19; 7/166–189, 7/143
See application file for complete search history.

(56) References Cited

U.S. PATENT DOCUMENTS

| | | | | |
|---|---|---|---|---|
| 102,677 | A | 5/1870 | Gregory | |
| 722,899 | A * | 3/1903 | Reeeder | 81/490 |
| 983,798 | A * | 2/1911 | Angell | 81/44 |
| 1,109,507 | A * | 9/1914 | Bostock | 81/23 |
| 1,387,316 | A * | 8/1921 | Schmidt | 81/44 |
| 2,005,176 | A * | 6/1935 | Arbuckle | 7/167 |
| 4,631,985 | A | 12/1986 | Roberts | |
| 4,843,923 | A | 7/1989 | Voss | |
| 5,701,675 | A * | 12/1997 | Hall et al. | 30/123 |
| 6,088,862 | A | 7/2000 | Bulcock | |
| 6,122,788 | A | 9/2000 | Bulcock | |
| 6,352,009 | B1 * | 3/2002 | Gaidjiergis | 81/44 |
| 7,013,516 | B1 | 3/2006 | Peters | |
| 7,100,475 | B1 * | 9/2006 | Rufolo, Jr. | 81/44 |
| 7,779,730 | B2 * | 8/2010 | Jones | 81/44 |
| 2006/0101948 | A1 | 5/2006 | Meitzler et al. | |

FOREIGN PATENT DOCUMENTS

| | | |
|---|---|---|
| JP | 2003-019674 | 1/2003 |

* cited by examiner

*Primary Examiner* — Hadi Shakeri
(74) *Attorney, Agent, or Firm* — Stephen R. Valancius

(57) ABSTRACT

A hammer device is provided for facilitating the driving, countersinking, and removal of relatively small fasteners, such as penny nails. A hammer includes a handle that can define an on-board tool storage area. A nail start accessory can include a tool portion and a nail holder portion. The tool portion can have a first end and a second end, with the nail holder portion being arranged at one of the first end and the second end. The on-board tool storage area of the hammer can be configured to removably store the nail start accessory substantially within the handle.

18 Claims, 14 Drawing Sheets

HAMMER WITH NAIL START ACCESSORY, AND METHOD

FIELD OF THE INVENTION

The present teachings relate to a hammer. In particular, the present teachings relate to a hammer device having an on-board tool storage area for a nail start accessory that can help facilitate the driving and removal of relatively small fasteners, such as penny nails.

BACKGROUND OF THE INVENTION

Efficiently driving and removing small fasteners, such as penny nails, by way of a hammer can be a challenging task. Positioning, holding, and driving small fasteners into a desired location can be particularly difficult. Moreover, removing unwanted or improperly driven small fasteners can be challenging as it can lead to the damage of wood trim, or other soft material. Known fastener holding tools assist in holding fasteners as one starts to drive them into a surface, but can be cumbersome to use and do not provide a way to remove previously driven fasteners with the same tool, see for example, U.S. Pat. Nos. 4,843,923 and 4,631,985. Thus, to be able to drive and/or remove small fasteners, it has been required to carry various different tools, including (i) a hammer, (ii) a fastener holding tool, (iii) an extractor, and/or (iv) a nail set.

Accordingly, there exists a need for an all-in-one hammer device that can conveniently hold, drive, countersink, and/or remove small fasteners. Furthermore, there also exists a need for a tool that can position and hold one or more nails at the time of initial driving. Further still, there exists a need for such a tool that can extract previously driven fasteners while causing little or no damage to a surface.

SUMMARY OF THE INVENTION

According to one embodiment, the present teachings disclose a hammer device including a handle defining an on-board tool storage area formed within the handle. The hammer device can also include a nail start accessory including a tool portion and a nail holder portion. The tool portion can have a first end and a second end, with the nail holder portion being arranged at one of the first end and the second end. The on-board tool storage area of the hammer can be configured to removably store the nail start accessory substantially within the handle.

According to another embodiment, the present teachings disclose a method of driving a fastener into a surface. The method can include providing the hammer device as set forth in the previous paragraph. The method further includes removing the nail start accessory from the on-board tool storage area of the handle of the hammer. The method can include inserting a fastener into the nail holder portion of the nail start accessory, positioning the nail holder portion in a location where it is desired to locate the fastener, and driving the fastener into the desired location on the surface with the hammer.

According to yet another embodiment, the present teachings disclose a hammer device including a hammer having an on-board tool storage area. The hammer device can include a nail start accessory including an elongate tool portion and a nail holder portion. The nail holder portion can be pivotably attached to an end of the elongate tool portion, and one of a nail set and a nail extractor can be formed at an opposite end of the elongate tool portion. The on-board tool storage area of the hammer can be configured to removably store the nail start accessory on the hammer.

According to a still further embodiment, the present teachings disclose a handheld tool including a tool portion having a first end and a second end. The handheld tool can further include a holder portion including a fastener holding structure and being arranged at one of the first end and the second end of the tool portion. A tool head can be arranged at the other of the first end and the second end of the tool portion.

Additional features and advantages of various embodiments will be set forth, in part, in the description that follows, and, in part, will be apparent from the description, or may be learned by practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DESCRIPTION OF THE INVENTION

Figure 1:
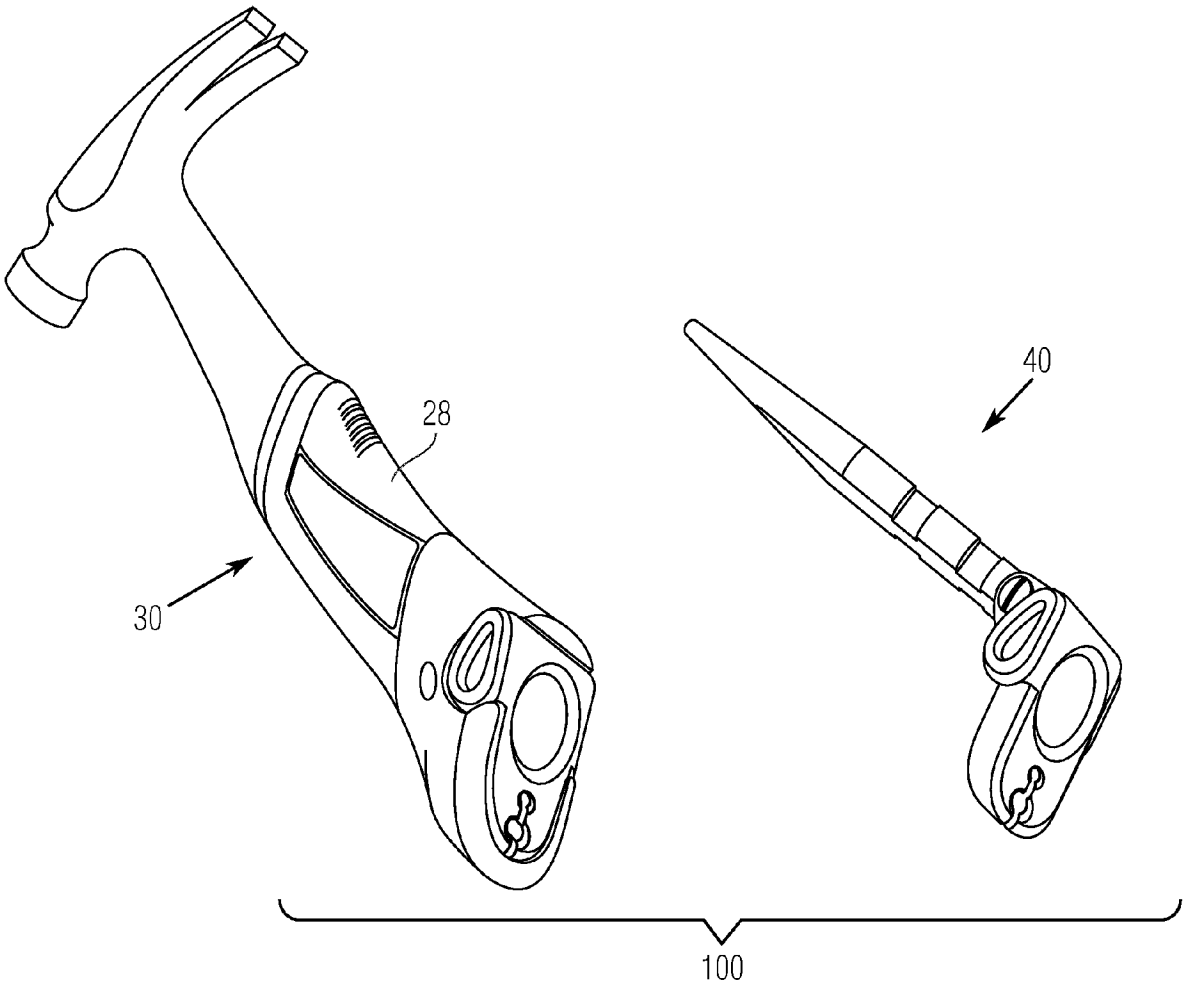
FIG. 1 shows a perspective view of the hammer device according to the present teachings, with the nail start accessory inserted into and removed from the hammer.

Referring to FIG. 1, the hammer device 100 of the present teachings is shown. The hammer device 100 can include a hammer 30 and a nail start accessory 40. The hammer 30 can include an on-board tool storage area 80 (shown in FIG. 4) formed in a handle 28 of the hammer 30 that is shaped to receive and securely store the nail start accessory 40. When the nail start accessory 40 is housed in the on-board tool storage area 80, the hammer 30 can be used to drive and remove various-sized fasteners in the manner of a convention hammer.

As will be described in more detail below, when it is desired to accurately hold, drive, and/or countersink a small fastener, such as a penny nail, brad, tack, screw and the like, the nail start accessory 40 can be removed from the on-board tool storage area 80 and used to perform one or more of such functions. The nail start accessory 40 can also be designed to incorporate other tools, such as a tool to remove unwanted or improperly driven fasteners, a tool to countersink fasteners, and the like. When a user has completed using the nail start accessory 40, they can readily insert it back into the on-board tool storage area 80 of the handle 28. The hammer 30 can be used as a conventional hammer with or without the nail start accessory 40 being inserted in the on-board tool storage area 80.

Figure 2:
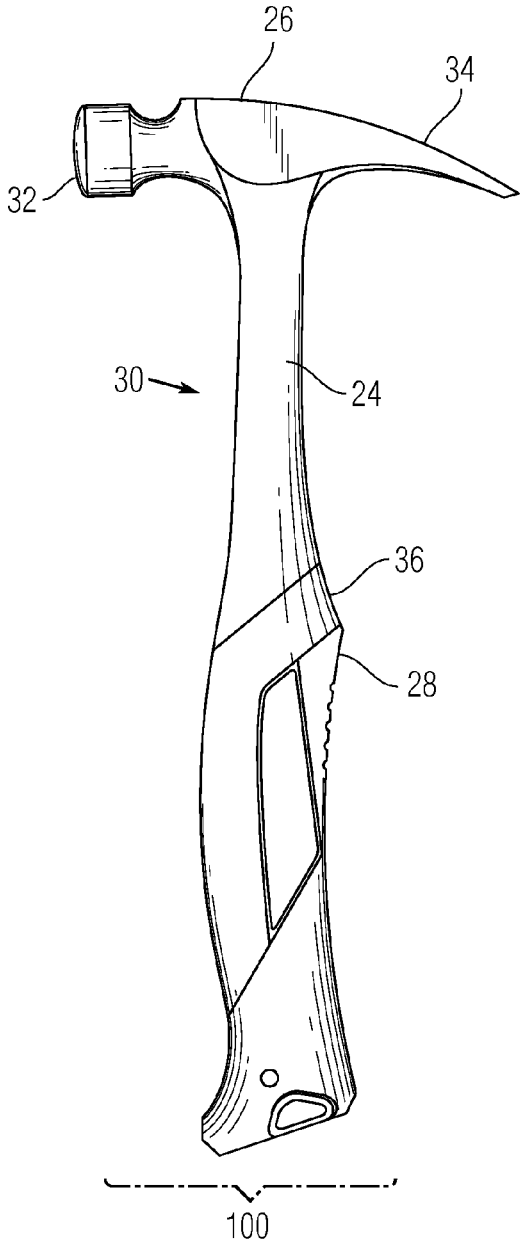
FIG. 2 is a side view of the hammer device of the present teachings.
Figure 3:
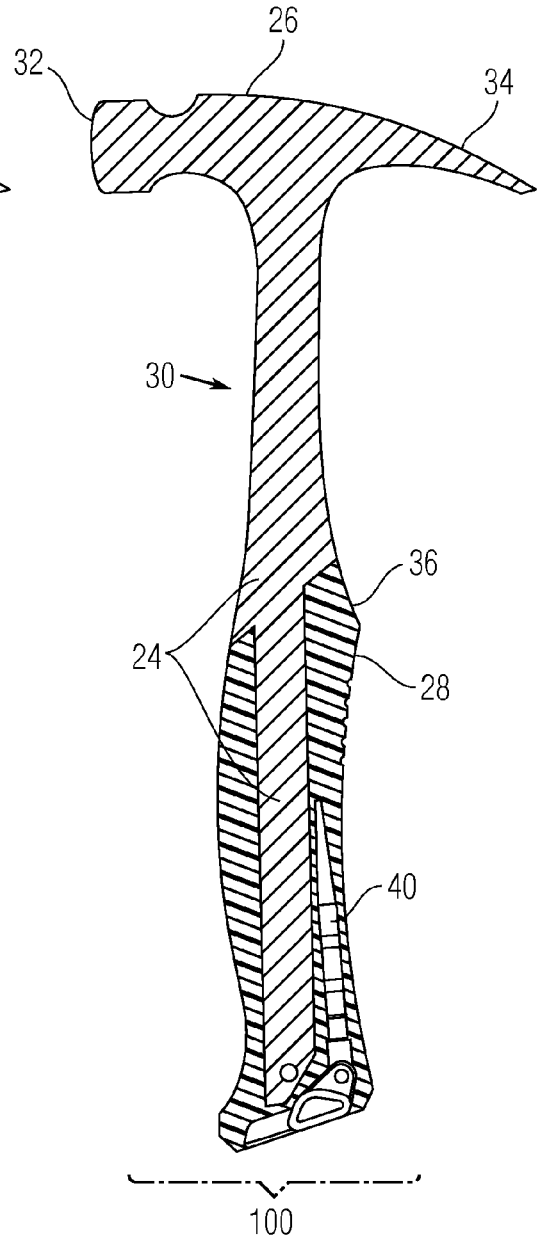
FIG. 3 is a schematic, cross-sectional side view of the hammer device of the present teachings.

Referring to FIGS. 2 and 3, the hammer device 100 of the present teachings is shown with the nail start accessory 40 inserted into the handle 28 of the hammer 30. The hammer 30 can include a shaft 24, a head 26, and a handle 28. As shown in cross-section in FIG. 3, a portion of the shaft 24 can be arranged to be surrounded by the handle 28. The head 26 can be made from a metal, such as forged steel, or any other solid, durable, and hard material, such as fiberglass. The head 26 can include a striking face 32 and a claw 34. The claw 34 can be sized and shaped to allow a user to extract standard sized fasteners, in the manner of a conventional hammer.

As shown in FIG. 3, the shaft 24 of the hammer 30 can be integrally formed with the head 26. However, the shaft 24 of the hammer 30 can be alternatively formed as a separate piece from the head 26 of the hammer 30. Like the head 26, the shaft 24 of the hammer 30 can be made from a metal, such as forged steel, or any other solid, durable, and hard material, such as fiberglass or wood.

Figure 4:
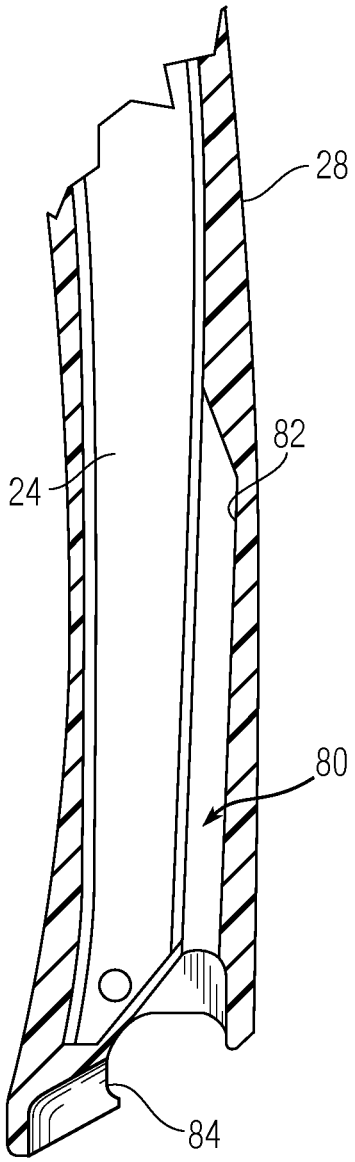
FIG. 4 shows a cross-sectional side view of the handle of the hammer with the nail start accessory being removed therefrom.
Figure 5:
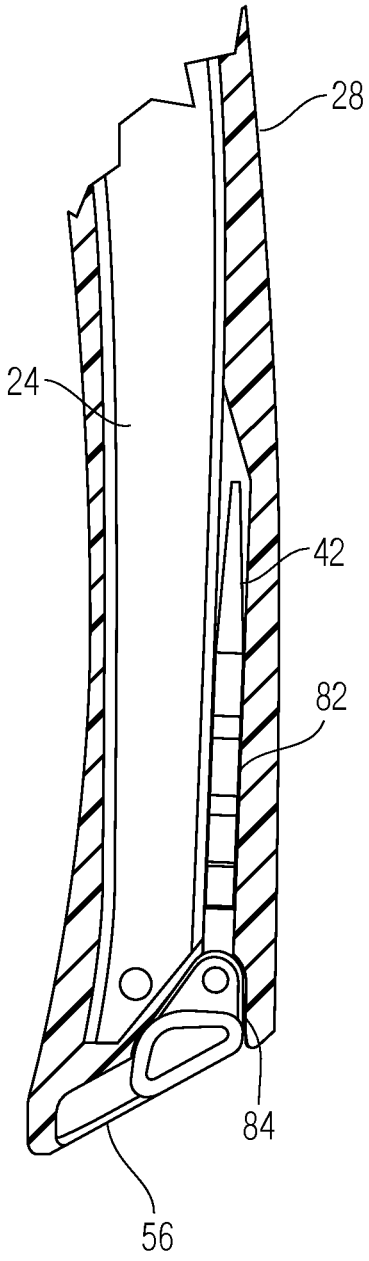
FIG. 5 shows a cross-sectional side view of the handle of the hammer with the nail start accessory being inserted therein.

The handle 28 of the hammer 30 can be overmolded onto a portion of the shaft 24. Other processes can be used to form the handle 28 including injection molding, vacuum forming, compression molding, and the like. A close-up, cross-sectional view of the gripping end of the hammer 30 is shown in FIGS. 4 and 5, where the handle 28 is shown overmolded onto an end of the shaft 24. The handle 28 can also be formed to include a cavity forming the on-board tool storage area 80. The on-board tool storage area 80 is shaped to house the nail start accessory 40.

As shown in FIG. 4, a portion of the on-board tool storage area 80 can be defined by the shaft 24 of the hammer 30. The remaining portion of the on-board tool storage area 80 can be defined by the handle 28. The on-board tool storage area 80 can include a first elongate cavity 82 and a second end cavity 84. In FIGS. 4 and 5, the on-board tool storage area 80 is formed within the handle 28 but it could be arranged at least partially on an exterior of the handle 28.

The handle 28 can be ergonomically shaped to allow a user's hand to comfortably grasp and securely grip the shaft 24 of the hammer 30. For example, referring to FIGS. 2 and 3, the handle 28 can be shaped to allow a user's fingers to wrap around the handle while the thumb naturally lands on a thumb rest area 36. Other shapes for the exterior portion of the handle 28 are also contemplated by the present teachings.

The handle 28 can be formed from rubber, silicon, or fiberglass, or any other durable and resilient material. The handle 28 can include one or more sections made from one or more different materials, with the grippable area being made from a durable, resilient, and slip-resistant material, such as, rubber or silicon, and the like. A portion of the handle 28 of the hammer 30 can be defined in whole or part by the shaft 24.

Figure 9:
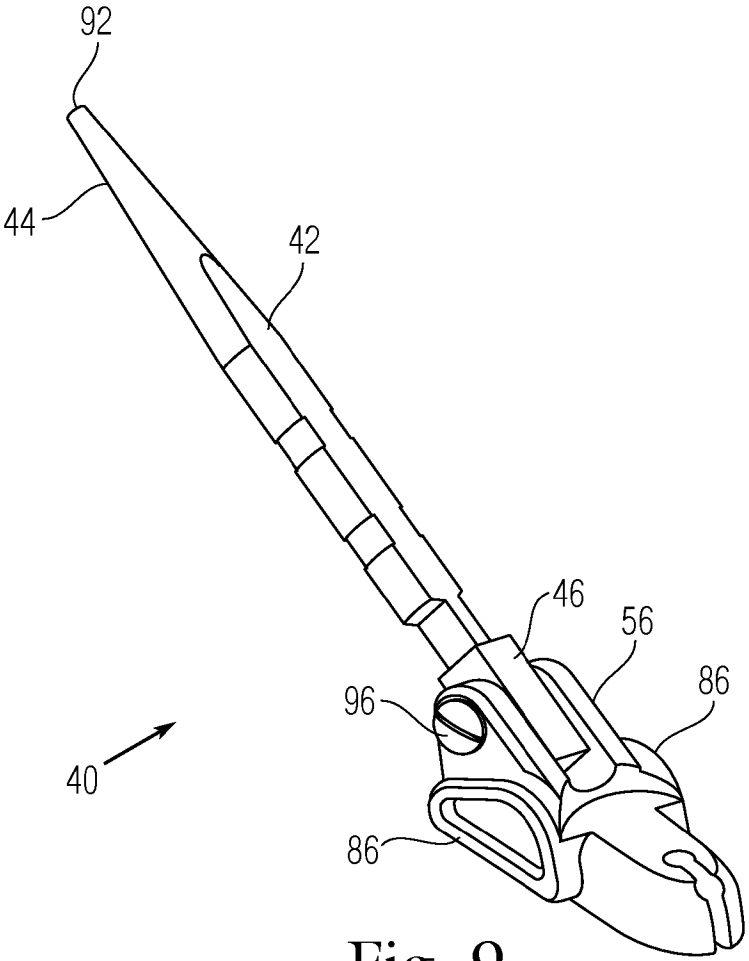
FIG. 9 shows a perspective view of the nail start accessory according to an embodiment of the present teachings.

One embodiment of the nail start accessory 40 is shown in FIG. 9. The nail start accessory 40 can include a tool portion 42 and a nail holder portion 56. The tool portion 42 can pivot with respect to the nail holder portion 56 through a pivot pin 96, or an equivalent structure. Additional details of the nail start accessory 40 will be discussed more fully below.

Referring to FIG. 5, the first cavity 82 of the on-board tool storage area 80 can be sized and shaped to house the tool portion 42 of the nail start accessory 40. The second end cavity 84 of the on-board tool storage area 80 can be sized and shaped to hold the nail holder portion 56 of the nail start accessory 40. As will be more fully discussed below, the second end cavity 84 can be shaped to secure the nail holder portion 56 to the handle 28 of the hammer 30, by way of, for example, a snap fit and/or any other type of latching mechanism.

Figure 6:
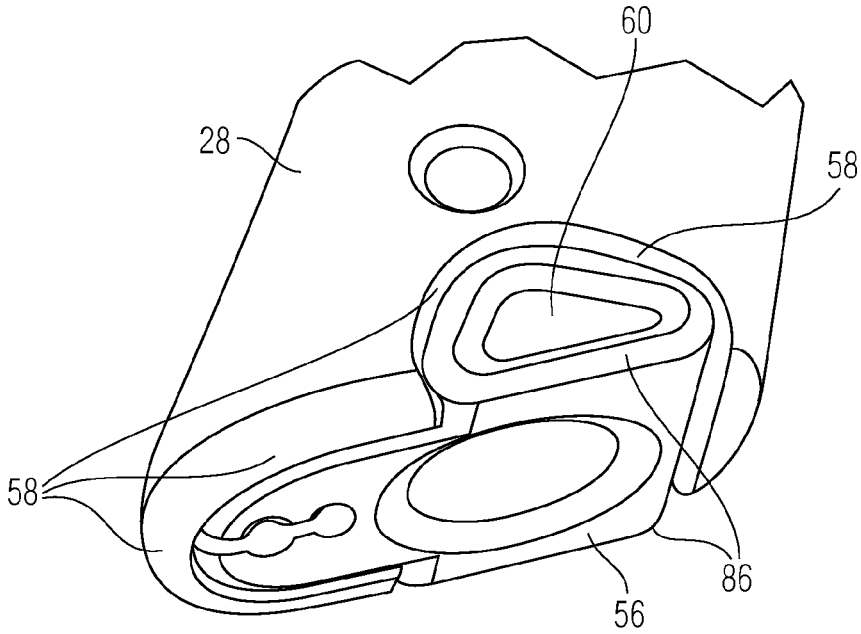
FIG. 6 shows a perspective view of the bottom end of the handle of the hammer with the nail start accessory being inserted therein.
Figure 7:
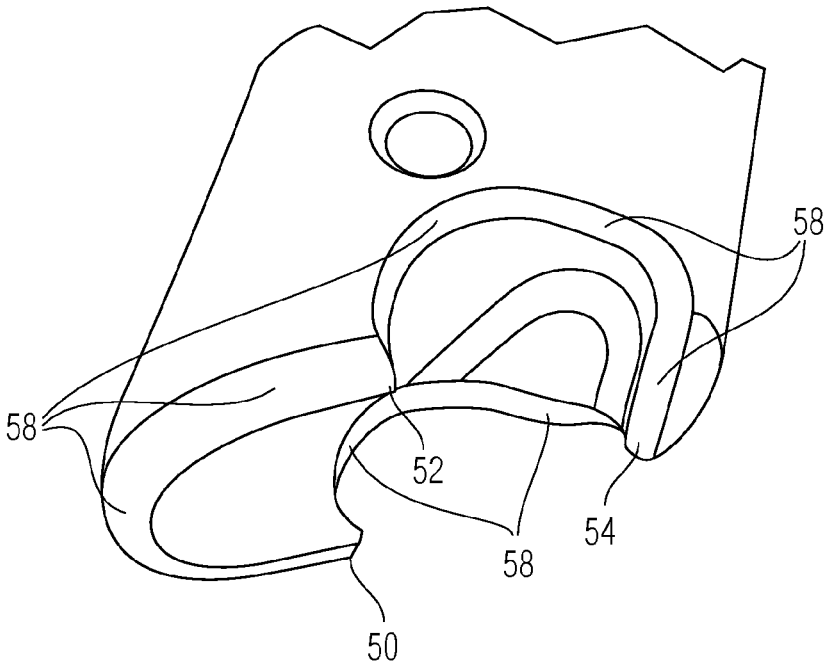
FIG. 7 shows a perspective view of the bottom end of the handle of the hammer with the nail start accessory being removed therefrom.

In this regard, FIG. 6 illustrates a close-up view of the nail holder portion 56 of the nail start accessory 40 being secured by a snap-fit structure to the handle 28. The snap-fit structure can be formed as part of a peripheral rim area 58 of the second end cavity 84, which is located at the base of the handle 28. Referring to FIG. 7, the snap-fit can be achieved by the formation of one or more snap features 50, 52, and 54 integrally formed as part of the peripheral rim 58 of the handle 28. Alternatively, the snap features 50, 52, and 54 can be formed by inserts or any other structure formed separately and secured to the peripheral rim 58.

The snap features 50, 52, and 54 are arranged to frictionally engage with and secure one or more portions of the nail holder portion 56 of the nail start accessory 40. For example, the snap features 50, 52, and 54 can be arranged to engage with lateral flanges 86 formed on either side of the nail holder portion 56. The walls defining the snap features 50, 52, and 54 are made to be sufficiently strong so as to be able to resiliently and removably hold the nail start accessory 40 within the on-board tool storage area 80 of the handle 28, while at the same time ensuring that the handle 28 does not feel weak when the nail start accessory 40 is removed from the hammer 30. In general, the handle 28 of the hammer 30 is shaped to house and secure the nail start accessory 40 in a manner such that any vibrations occurring when the hammer 30 is being used are minimized, or substantially eliminated. The snap features 50, 52, and 54 can be formed at the time of formation of the handle 28, such as during an overmolding process.

Referring to FIG. 6, when the nail start accessory 40 is secured within the on-board tool storage area 80, a bottom portion of the nail holder portion 56 can be visible and can form a substantially flush surface with a bottom end of the handle 28 of the hammer 30. The nail holder portion 56 can include finger grip areas 60 on either side thereof. Each finger grip area 60 is surrounded by a lateral flange 86 of the nail holder portion 56, thereby forming a concavity so as to provide finger or thumb receiving areas. Together, both finger grip areas 60 allow a user to obtain a firm grip on the nail holder portion 56. This is especially desirable when slidably removing the nail start accessory 40 from the handle 28, and overcoming the force of the snap fit achieved by the snap features 50, 52, and 54. The finger grip areas 60 also allow a user to firmly grip the nail start accessory 40 while it is being inserted into the handle 28, as well as when it is desired to pivot the nail holder portion 56 with respect to the elongated tool portion 42.

Figure 8:
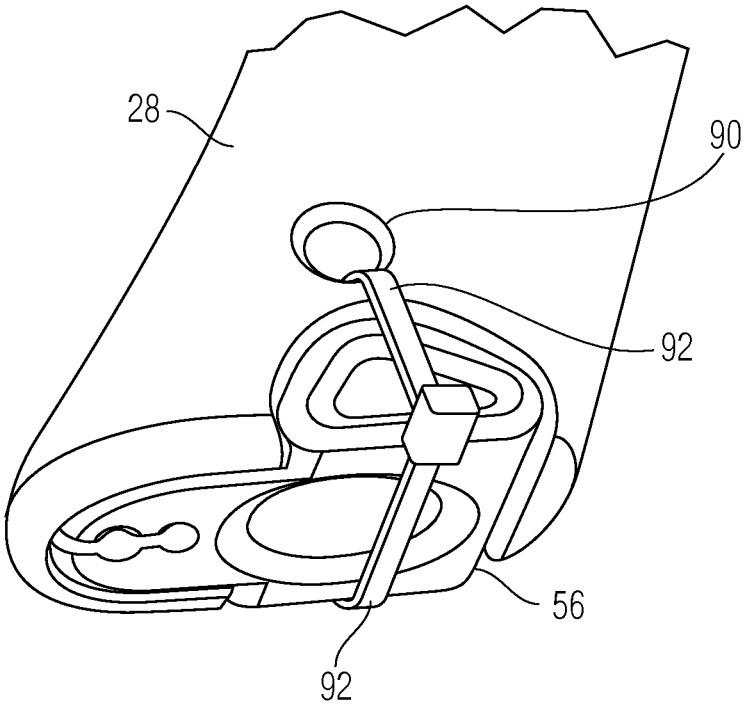
FIG. 8 shows a perspective view of the bottom end of the handle of the hammer with the nail start accessory being secured thereto.

Referring to FIG. 8, an aperture 90 can be provided within the handle 28. Among other uses, the aperture 90 can be used to secure the nail start accessory 40 within the handle 28. A tie-wrap 92, or similar device, can be threaded through the aperture 90 and secured around the nail holder portion 56 of the nail start accessory 40 to prevent it from being removed from the hammer 30. The aperture 90 can be formed in the shaft and can extend though the handle 28. In this manner, the nail start accessory 40 can be secured in a tamperproof manner to the handle 28 of the hammer 30. Securing the nail start accessory 40 to the handle 28 can be beneficial during shipping and when the hammer device 100 is displayed in a retail environment, for example.

Figure 10:
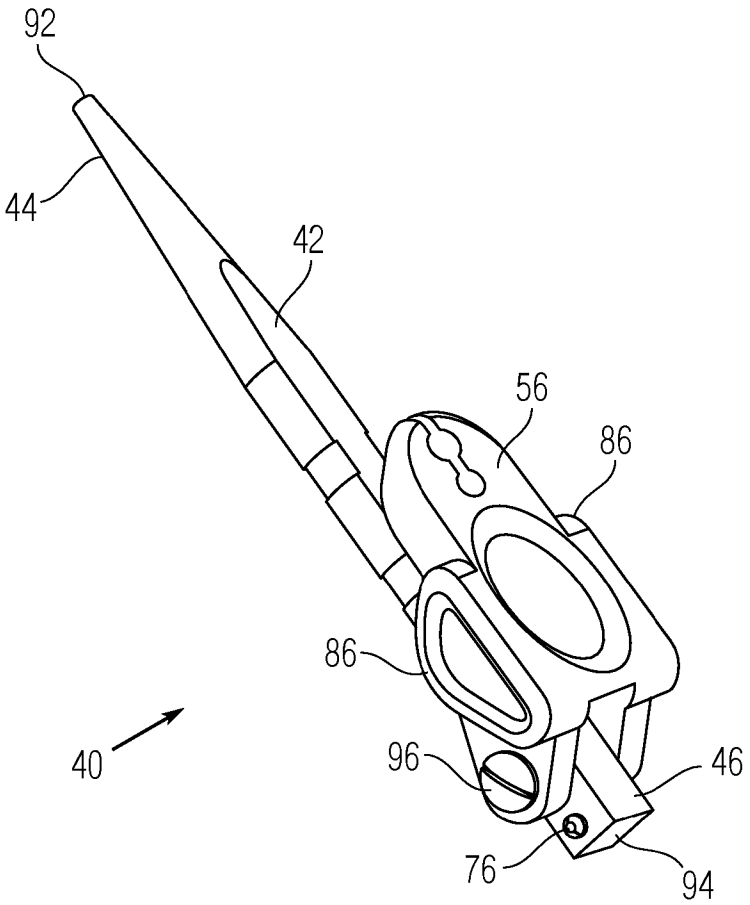
FIG. 10 shows a perspective view of the nail start accessory of FIG. 9 with the nail holder portion being pivoted upwardly.

FIGS. 9 and 10 show detailed views of the nail start accessory 40 of one embodiment of the present teachings. The nail start accessory 40 can include a tool portion 42 and a nail holder portion 56. The tool portion 42 can be formed as an elongate rod including a first end 44 and a second end 46. In the vicinity of the second end 46, the elongated tool portion 42 can be pivotally connected to the nail holder portion 56. The tool portion 42 can be made from a metal, such as forged steel, or any other solid, durable, and hard material. The nail holder portion 56 can be made in whole, or in part, of a resilient material, such as rubber or silicon. The nail holder portion 56 is preferably made of a non-marring material so as to not mark a surface it is placed in contact with.

According to the embodiment shown in FIGS. 9 and 10, the elongated tool portion 42 can form a nail set for countersinking nails or other fasteners. In particular, the first end 44 of the elongated tool portion 42 can be arranged to taper to a tip having a flat portion 92. At the second end 46 of the elongated tool portion 42, a flat end surface 94 can form a strikable surface. In use, the nail holder portion 56 can be pivoted so that the flat end surface 94 of the elongated tool portion 42 is exposed. This position allows the end surface 94 to be struck by the hammer 30 resulting in the countersinking of a fastener which is contacted by the flat tip portion 92 of the elongated tool portion 42, see FIGS. 10 and 22.

When it is desired to insert the elongated tool portion 42 back into the handle 28, the nail holder portion 56 can be pivoted back to the position shown in FIG. 9 by gripping the finger grip areas 60 and pivoting the nail holder portion 56. The tool portion 42 can then be re-inserted into the first cavity 82 of the on-board tool storage area 80 of the handle 28 until the nail holder portion 56 snaps into place within the second end cavity 84.

Figure 11:
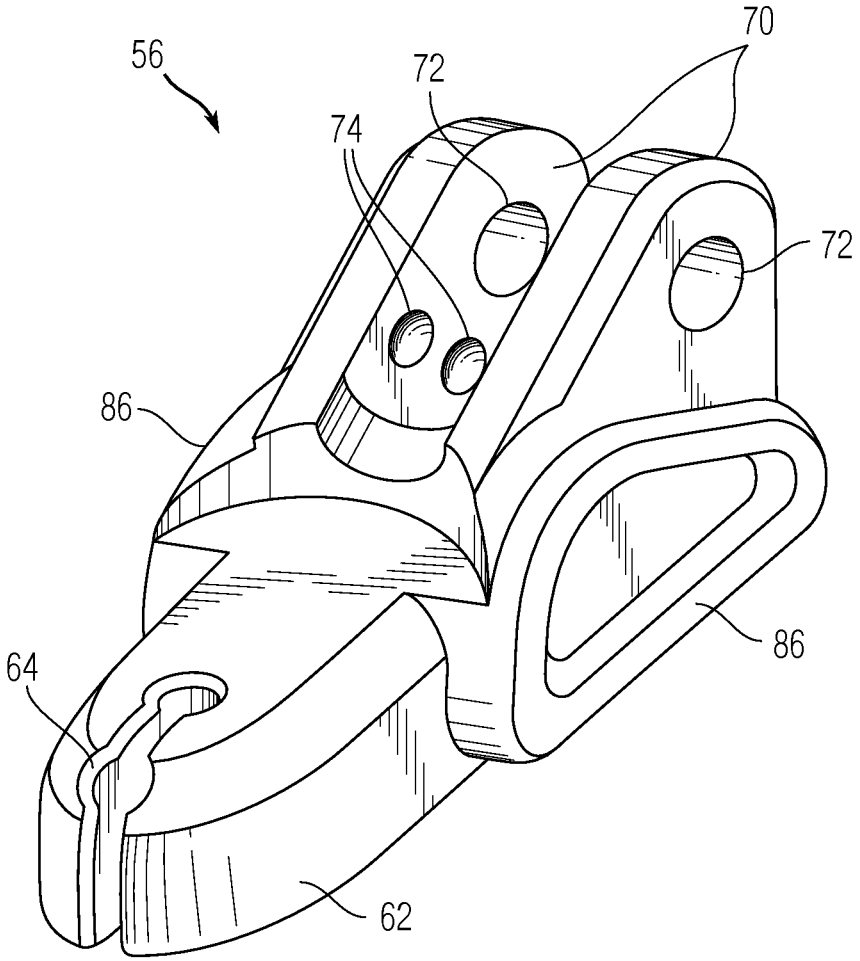
FIG. 11 shows a perspective view of the nail holder portion of the nail start accessory of FIGS. 9 and 10 according to various embodiments.

Referring to FIG. 11, the nail holder portion 56 of the nail start accessory 40 is shown detached from the elongated tool portion 42. One end of the nail holder portion 56 can include a head portion 62 that is formed with a fastener holding groove 64. The opposite end of the nail holder portion 56 can include one or more projecting ears 70 for supporting the pivotable connection with the elongated tool portion 42. At least a portion of the nail holder portion 56 can be made of a resilient material that allows it to frictionally hold one or more fasteners within the fastener holding groove 64. The resilience of the nail holder portion 56 provides protection to a surface from an inadvertent missed strike by the hammer 30. The head portion 62 of the nail holder portion 56 can have any size, shape, and thickness, and can be arranged to insert into, and be securely housed within, a complimentarily-shaped portion of the on-board tool storage area 80 of the handle 28.

Figure 12:
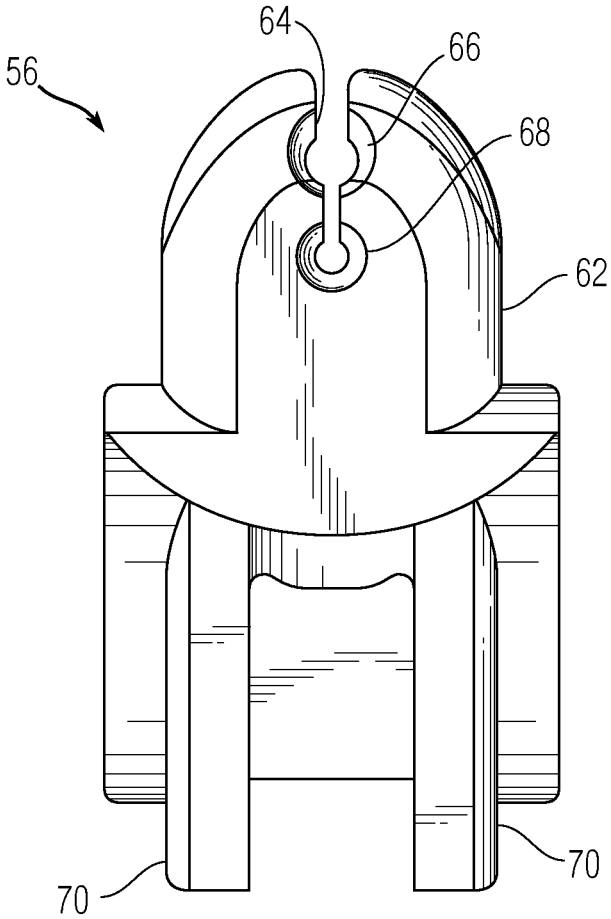
FIG. 12 shows a top view of the nail holder portion of FIG. 11 according to various embodiments.

The fastener holding groove 64 of the nail holder portion 56 can be arranged to securely hold fasteners of various sizes. Referring to FIGS. 11 and 12, the fastener holding groove 64 can be generally V-shaped such that different sized fasteners can be snuggly held along a length of the groove 64. At any particular time, one or more fasteners can be held within the groove 64. While the groove 64 is capable of holding fasteners of various sizes, it can be of a general size and shape for holding relatively small-sized fasteners, such as penny nails. As best shown in FIG. 12, the V-shaped groove 64 can also be formed with one or more enlarged areas or openings, such as openings 66, 68. These enlarged openings 66, 68 provide additional areas for frictionally holding fasteners.

Figure 13:
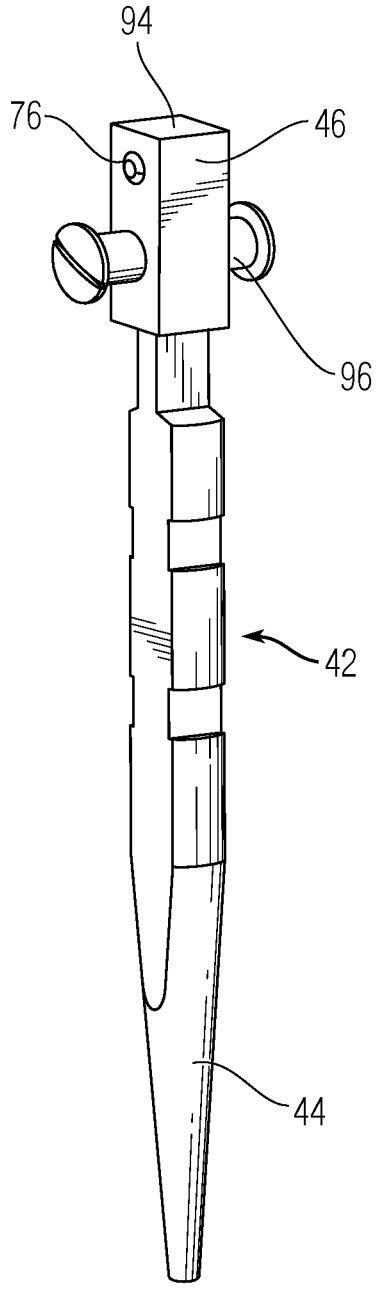
FIG. 13 shows a perspective view of the elongate tool portion of the nail holder portion of FIGS. 9 and 10.

As shown in FIG. 11, the nail holder portion 56 can include one or more projecting ears 70. The ears 70 can be arranged to provide a connection, such as a pivotable connection, between the nail holder portion 56 and the elongated tool portion 42. For example, the ears 70 can be provided with apertures 72 into which a pivot pin 96, or similar structure, such as a rivet, can be inserted to achieve the pivotable connection between the nail holder portion 56 and the elongate tool portion 42, see FIGS. 9 and 13.

A locking mechanism can be provided between the nail holder portion 56 and the tool portion 42 in order to temporarily lock the pivot angle between the nail holder portion 56 and the tool portion 42 at one or more pivot angles. The locking mechanism can include one or more dimples 74 formed on inner surfaces of the ears 70 of the nail holder portion 56 which are arranged to receive resilient detents or pins 76 formed on the elongated tool portion 42. The dimples 74 can be positioned and shaped so as to receive the resilient detents 76 as the nail holder portion 56 is pivoted with respect to the tool portion 42. In this manner, the elongate tool portion 42 can be arranged to be temporarily lock at one or more preset pivot angles with respect to the nail holder portion 56.

Figure 14:
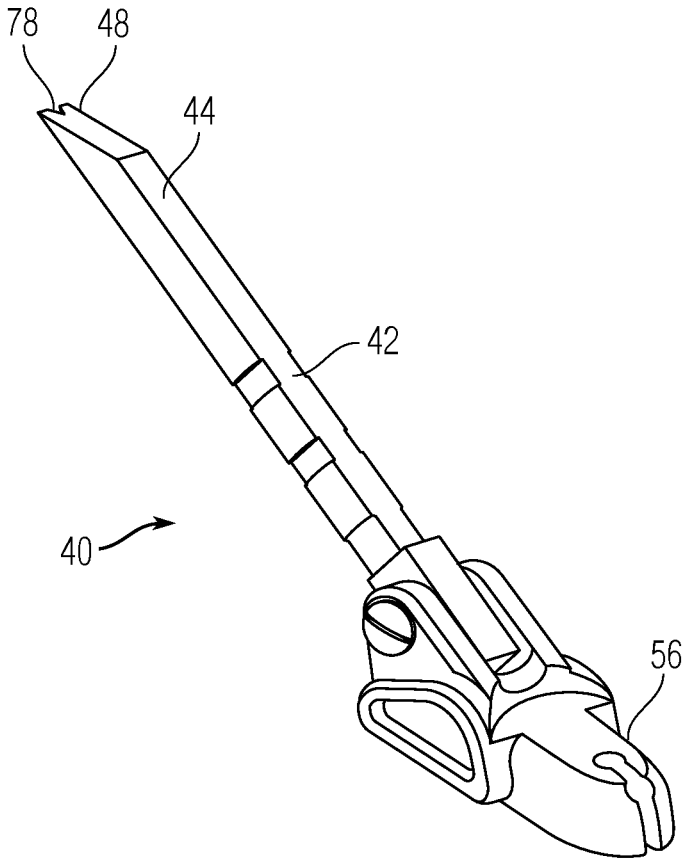
FIG. 14 shows a perspective view of the nail start accessory according to another embodiment of the present teachings.
Figure 15:
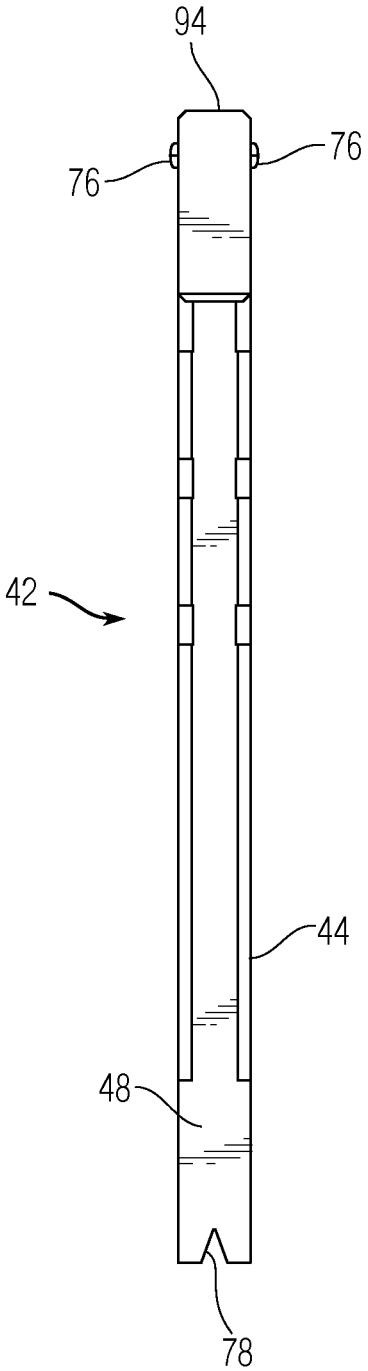
FIG. 15 shows a top view of the elongate tool portion of the nail start accessory of FIG. 14.
Figure 16:
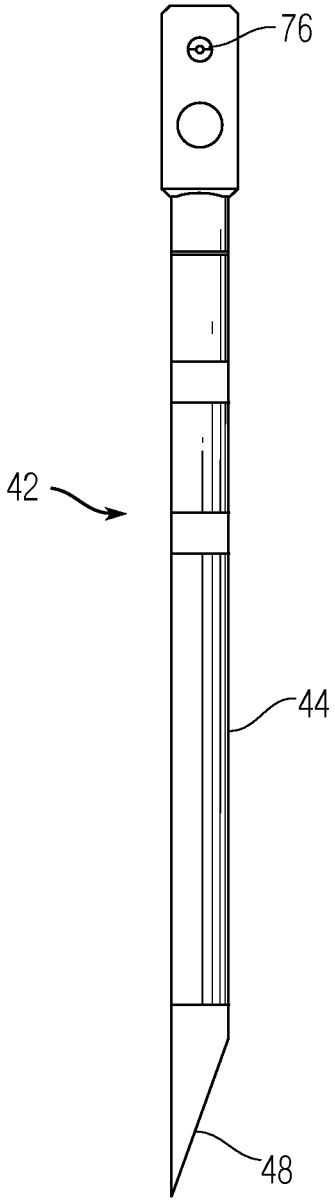
FIG. 16 shows a side view of the elongate tool portion of the nail start accessory of FIG. 14.

FIG. 14 shows an alternative tool design for use at the first end 44 of the elongate tool portion 42 of the nail start accessory 40. FIGS. 15 and 16 also show this alternative design for the elongate tool portion 42 but without the nail holder portion 56 being pivotally attached thereto. In this alternative design, the first end 44 can be formed with a nail extractor 48 including a notch 78. The nail extractor 48 can be in the form of a chisel tip or claw, or any shape which can readily reach and extract a previously driven fastener. While the chisel and the notch 78 of the nail extractor 48 can be designed to extract various sized fasteners, it can be made of a general size and shape for extracting relatively small-sized fasteners, such as penny nails. The nail extractor 48 can be designed to minimize or eliminate the possibility of damage to a surface, which oftentimes is made of a soft material, such as is the case with wood trim. The nail extractor 48 can be integrally formed in one-piece with the elongate tool portion 42 of the nail start accessory 40. The nail extractor 48 can be made from metal, such as forged steel, or some other solid, durable, and hard material, such as a hard plastic. The nail extractor 48 can be overmolded with, or made entirely from, a non-marring material.

Figure 20:
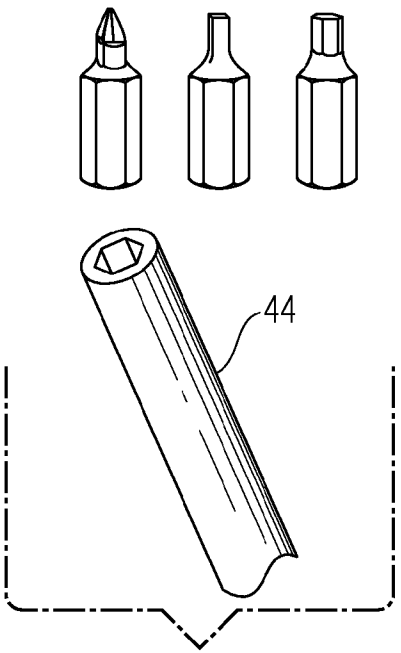
FIGS. 17-20 show various tools that can be formed at an end of the elongate tool portion of the nail start accessory according to various embodiments.
Figure 19:
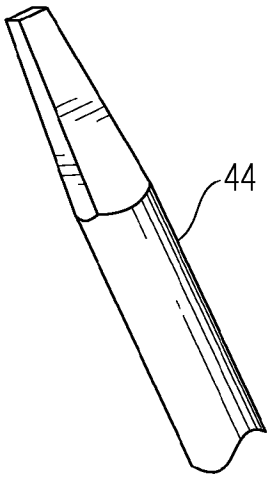
Figure 18:
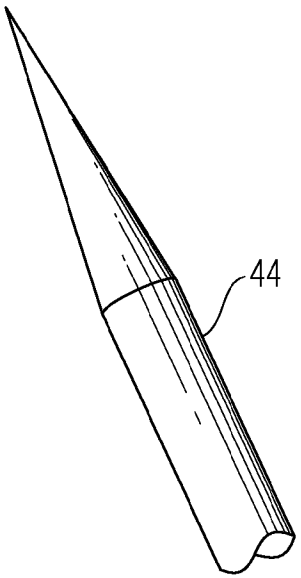
Figure 17:
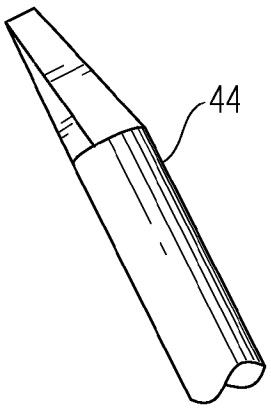

FIGS. 17-20 show still further alternative tool designs for the first end 44 of the elongate tool portion 42 of the nail start accessory 40. FIG. 17 shows a chisel tip; FIG. 18 shows a pointed tip, or prick punch tip; FIG. 19 shows a screwdriver tip; and FIG. 20 shows a hex tip which can be used to receive bits having different shapes, such as a screwdriver bit, a Phillips bit, an Allen wrench bit, and the like.

Due to their relatively small size, initially holding and driving penny nails can be extremely challenging, even for experienced handymen. Subsequently countersinking and removing penny nails can also be cumbersome requiring additional tools. The hammer device 100 of the present teachings allows penny nails (and other fasteners) to be readily supported at the time they are being initially driven into a surface, and to be quickly and easily countersunk and extracted, if needed. The hammer device 100 can be especially useful when installing finishing trim using small fasteners, or installing other delicate pieces. However, the hammer device 100 can also be used as a conventional hammer with the nail start accessory 40 being stored or removed from the handle 28 of the hammer 30.

Figure 21:
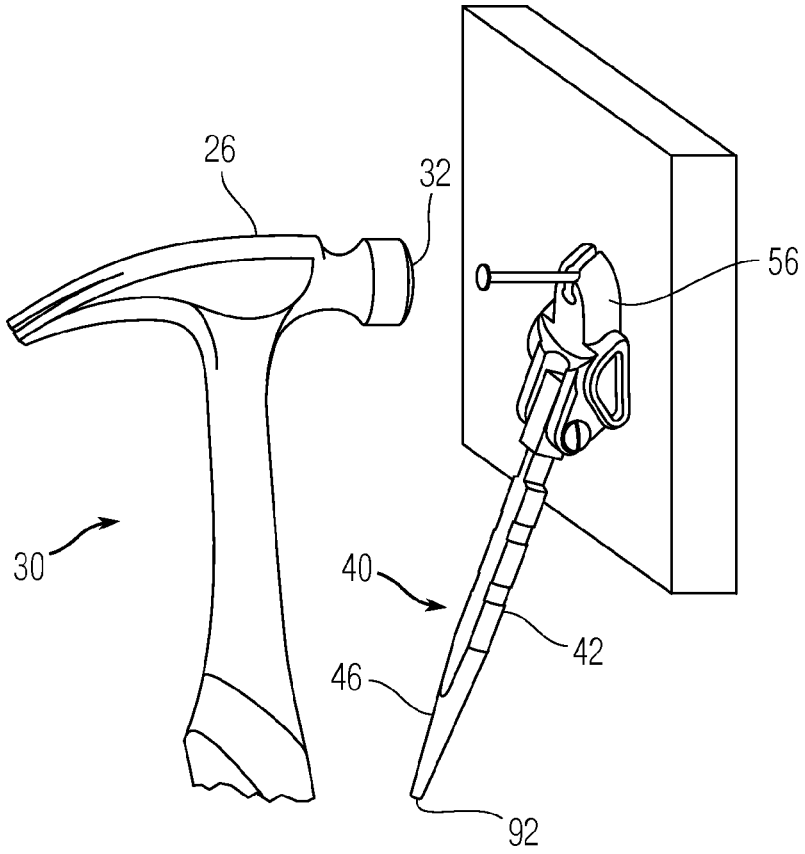
FIG. 21 shows the nail start accessory of FIG. 9 being used to drive a fastener into a surface.

In use of the hammer device 100 of the present teachings, in order to more readily drive a penny nail into a surface, a user can remove the nail start accessory 40 from the on-board tool storage area 80 of the hammer 30. The nail holder portion 56 is then pivoted with respect to the elongate tool portion 42 into a position as desired by the user. As shown in FIG. 21, after inserting a penny nail into the nail holder portion 56 of the nail start accessory 40, the user can accurately position and hold the penny nail in the location on the surface where it is desired to drive the penny nail. While holding the elongate tool portion 42 and/or the nail holder portion 56 of the nail start accessory 40, the penny nail can be tapped into the surface with the hammer 30. Once the penny nail is partially driven into the surface, the nail start accessory 40 can be moved out of contact with the nail, at which point the nail can be driven all of the way into the surface using the hammer 30.

Figure 22:
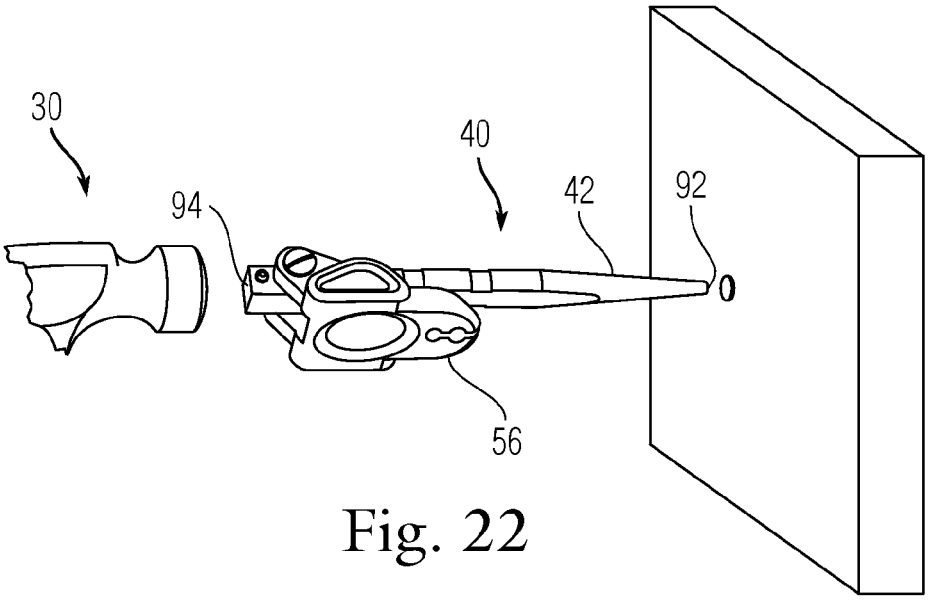
FIG. 22 shows the nail start accessory of FIG. 9 being used to countersink a fastener after it has been driven into the surface.

Referring to FIG. 22, where the nail is shown driven completely into the surface, if it is desired to countersink the penny nail, the flat tip 92 of the elongate tool portion 42 of the nail start accessory 40 can be placed on the head of the nail, and the opposite end of the elongate tool portion 42 can be tapped at the flat end surface 94, thereby countersinking the nail below the surface plane.

When the user is done using the nail start accessory 40, it can be conveniently stored within the hammer 30 by pivoting the elongate tool portion 42 with respect to the nail holder portion 56, and sliding it back into the on-board tool storage area 80. At this point, the hammer 30 can be used to drive and remove various sized fasteners in the manner of a convention hammer.

Accordingly, the hammer device 100 of the present teachings allows a user to conveniently maintain several related tools within a single device while making it relatively easy to hold, manipulate, drive, countersink, and remove small fasteners, such as penny nails.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A hammer device comprising:

a hammer including a head, a shaft and a handle, the shaft having a longitudinal axis substantially perpendicular to a longitudinal axis of the head, the handle surrounding a portion of the shaft and defining an on-board tool storage area formed within the handle;

a tool accessory;

wherein the on-board tool storage area of the hammer is configured to removably store the tool accessory substantially within the handle;

wherein the on-board tool storage area is formed within a portion of the handle that surrounds a portion of the shaft;

wherein the tool accessory comprises a nail start accessory including a tool portion and a nail holder portion, the tool portion having a first end and a second end with the nail holder portion being arranged at one of the first end and the second end;

wherein at least part of the stored nail start accessory forms part of the outside profile of the hammer device wherein the nail holder portion is arranged to pivot with respect to the tool portion; and further comprising a locking mechanism between the nail holder portion and the tool portion such that a pivot angle between the nail holder portion and the tool portion is lockable in at least one setting.

2. The hammer device of claim 1, wherein the nail holder portion is capable of being pivoted into a position that exposes an end surface of the tool portion such that the end surface is directly strikeable by the hammer.

3. The hammer device of claim 1, wherein the on-board tool storage area of the handle is shaped to removably secure the nail holder portion of the nail start accessory to the handle.

4. The hammer device of claim 3, wherein a portion of the on-board tool storage area of the handle is defined by a peripheral rim which is configured to engage with and secure the nail holder portion of the nail start accessory to the handle.

5. The hammer device of claim 4, wherein the peripheral rim includes at least one snap feature which is configured to engage with and secure the nail holder portion of the nail start accessory to the handle.

6. The hammer device of claim 1, wherein the nail holder portion includes a fastener holding groove.

7. The hammer device of claim 6, wherein the fastener holding groove includes a substantially V-shaped groove including at least one notch formed along the groove.

8. The hammer device of claim 1, wherein the nail holder portion is formed of a resilient material.

9. The hammer device of claim 1, wherein a nail set is arranged at the other of the first end and the second end of the tool portion.

10. The hammer device of claim 1, wherein a nail extractor is arranged at the other of the first end and the second end of the tool portion.

11. The hammer device of claim 1, wherein one of a i) chisel, ii) a prick punch, iii) a screwdriver, and iv) a hex tip capable of receiving bits, is arranged at the other of the first end and the second end of the tool portion.

12. The hammer device of claim 1, wherein the nail start accessory forms part of a butt end of the hammer device.

13. The hammer device of claim 12, wherein the nail start accessory includes a tool portion and a nail holder portion, the tool portion having a first end and a second end with the nail holder portion being arranged at one of the first end and the second end, and wherein the nail holder portion forms part of the butt end of the hammer device.

14. The hammer device of claim 1, wherein the handle comprises at least one of a rubber and silicon and wherein the shaft comprises at least one of metal, fiberglass and wood.

15. The hammer device of claim 1, wherein the head has a striking face that is substantially perpendicular to the longitudinal axis of the head.

16. The hammer device of claim 1, wherein at least most of the handle surrounds a portion of the shaft.

17. The hammer device of claim 1, wherein the shaft comprises a first section which is not covered by the handle and a second section which is covered by the handle, wherein the first section is closer to the head than the second section and has a greater circumference than the second section.

18. The hammer device of claim 1, wherein the shaft extends through at least most of the handle and to a bottom end of the hammer.

* * * * *